United States Patent [19]

Ahrel

[11] 4,090,672

[45] May 23, 1978

[54] GRINDING APPARATUS

[75] Inventor: Bo A. Ahrel, St. Lambert, Canada

[73] Assignee: ALF Societe Anonyme, Fribourg, Switzerland

[21] Appl. No.: 713,433

[22] Filed: Aug. 11, 1976

[30] Foreign Application Priority Data

Aug. 12, 1975 Germany ..... 2535979

[51] Int. Cl.[2] ..... B02C 7/12

[52] U.S. Cl. ..... 241/261.1; 241/261.3; 241/296

[58] Field of Search ..... 241/244, 261.1, 261.3, 241/296, 297, 298, 260

[56] References Cited

U.S. PATENT DOCUMENTS

| | | | |
|---|---|---|---|
| 1,091,654 | 3/1914 | Aamachek | 241/296 |
| 3,040,997 | 6/1962 | Borden | 241/296 X |
| 3,674,217 | 7/1972 | Reinhall | 241/296 X |
| 3,974,971 | 8/1976 | Reinhall | 241/261.3 |

*Primary Examiner*—Roy Lake
*Assistant Examiner*—Howard N. Goldberg
*Attorney, Agent, or Firm*—Eric Y. Munson

[57] ABSTRACT

A grinding apparatus for producing ligno-cellulose pulp, in which the pulp material, such as wood chips or bagasse, is ground in an environment of steam between a rotating grinding disc and a non-rotating grinding disc enclosed within a housing. Each disc comprises a series of peripherally disposed, radially extending segments provided with ridges and intervening grooves forming opposing grinding surfaces and defining therebetween a grinding space of predetermined width which merges with a central feed-in zone from which the pulp material is propelled by centrifugal force created by the rotating disc, radially outwards through the grinding space. The rotating disc is shaped so as to cause the centrifugal force to fling the pulp material towards the nonrotating disc to thereby create passage means adjacent the surface of the rotating disc through which the steam escapes from the grinding space substantially free of pulp material, the radially outward movement of which is retarded by the non-rotating disc with resultant improved grinding effect.

9 Claims, 5 Drawing Figures

GRINDING APPARATUS

FIELD OF THE INVENTION

This invention relates to production of pulp from ligno-cellulose-containing materials such as wood or bagasse or similar vegetable material.

More particularly, this invention relates to a device in grinding apparatus for production of pulp from ligno-cellulose-containing materials and comprises a pair of grinding discs which rotate relative to one another and define therebetween a gap or interspace for the material to be ground, the sides of the discs facing one another having ridges and grooves for processing the material to be ground, the grinding gap or interspace having extension in both axial and radial directions.

BACKGROUND OF THE INVENTION

In a grinding apparatus of the kind in consideration, also referred to as a disc refiner, for defibration and additional grinding of the material, the pulp raw material when passing from the center to the periphery between the grinding discs is acted upon mechanically by the ridges and grooves of said discs. In order to obtain sufficient defibration and impart to the pulp good properties in other respects, it is often necessary to supply great quantities of mechanical energy per ton of ground produce. In many cases, more than 1,000 kWh or even more are supplied for each ton of produced pulp calculated as bone-dry. When grinding the raw material, such as wood chips, for example, which has a relatively high content of dry substance, a product having longer fiber length and, at the same time, great tear strength, has proved to be obtainable. Usually the grinding is carried out with material having a dry content of 20% and more.

The energy supplied in the grinding operation is converted mainly into heat, which in turn, if the dry content of the grinding produce is high, only to a minor degree can be absorbed by heating the pulp material and the entrained water. The major portion of the generated heat causes evaporation of water with consequent generation of great quantities of steam.

In the defibration and additional grinding of ligno-cellulose material in disc refiners for production of paper pulp, usually one ton of steam and even more is generated per ton of produced pulp calculated as bone-dry. The volume at atmospheric pressure of the generated quantity of steam may amount to 2,000 cubic meters or more per ton of produced pulp. This steam quantity is generated in the disc refiner in the grinding gap or interspace between the grinding discs and must in some way be discharged from the zone where it is gennerated. A great portion, often the major portion, of the steam flows radially outwards towards the outer periphery of the grinding interspace. To a great extent the flow takes place through grooves in the grinding surfaces and often at velocities on the order of some hundred meters per second. Another portion of the steam flows out from the grinding zone in the direction towards the center of the grinding discs.

This high steam velocity results in the grinding produce being carried along with the steam, especially in the outer portion of the grinding zone, thereby causing the grinding produce or grist to be blown out from the grinding zone before it has undergone a satisfactory grinding operation. Consequently, the outermost portion of the grinding zone will work less effectively. The farther out towards the periphery, the greater are the steam quantities generated and the higher are the velocities imparted to this steam.

SUMMARY OF THE INVENTION

One main object of the present invention is to reduce the tendency of the grinding produce too readily to follow the steam in outward direction. This is attained essentially by shaping the rotating disc, at least at its outer portion, so that the produce will be flung in a direction away from the rotating disc towards the non-rotating disc and thereby form an unobstructed passage adjacent the surface of the rotating disc for allowing the steam generated in the grinding operation to escape.

In the device according to the invention, the grinding produce is centrifuged outwards towards the surface of the non-rotating grinding disc. In order to retard the movement of the grinding produce towards the periphery, the invention proposes to form the ridges and grooves on the surface of the non-rotating disc so as to create a substantially greater resistance to the radial flow of steam and grinding produce than that offered by the surface of the rotating disc. This will result, first, in making it more difficult for the grinding produce to slide along said surface, and, second, the steam flow in the grooves will be retarded. If, for example, the stationary grinding surface is formed with radial grooves, said grooves must have a great number of transverse ridges in order to decelerate the flow of both produce particles and steam.

It will be readily understood from the preceding description, that according to the invention, the accumulation of grinding produce adjacent the non-rotating grinding surface will be increased and the radial movement thereof will be retarded, whereas a relatively small quantity of grinding produce will accumulate adjacent the rotating surface and particularly in the grooves thereof, which will enhance the radial flow of the steam at this surface. Thus, the grooves in the non-rotating surface are relieved from having to remove steam. Therefore, this non-rotating surface can have a pattern narrower than the usual pattern heretofore used. Thus, in the manufacture of certain pulp grades, it will be possible to give the non-rotating grinding surface an extremely fine pattern by making it of granular material, for example. According to the invention, the grinding surface of the non-rotating disc preferably is made of granular material with the granules of at least the outer portion having a size of 1.5 millimeters, preferably 0.5 millimeters, and most suitably 0.3 millimeters at the most. In this connection, the granules may be cemented to one another by some sintering or bonding material which is affected more rapidly by wear or erosion than the hard and resistant granular material.

As will be understood from the foregoing explanation, some separation of steam and solid particles is brought about by the centrifugal force resulting from the rotation. This effect can be augmented by giving the grinding gap or interspace, at least the outer portion thereof, a cup-like shape, the non-rotating disc being concave and the rotating disc being convex. In this way, the steam is forced to flow along a curved path.

Some centrifugal separation of grinding produce from the steam could also be obtained in a grinding apparatus having completely conical grinding surfaces. However, according to the present invention, it is mainly in the peripheral zone that the shape in question is of importance. In order to avoid an unnecessarily heavy rotating disc and unnecessarily great spacing between the bearings, it is more advantageous to keep the main portion of the discs planar. Therefore, in accordance with the invention, the grinding gap or interspace between the center of rotation and the periphery has a portion which extends substantially prependicularly to the axis of rotation. However, this feature does not exclude that a minor portion of the discs adjacent the axis can be formed conically, which, in some cases, may be of some advantage in several types of apparatus to facilitate the introduction of the material to be ground.

According to the invention, it is of decisive importance to retard the speed of radial movement of the grinding produce near the periphery. When operating with grinding surfaces of metal having small grooves, an additional retardation of the grinding produce can be obtained by having the grooves in at least one of the grinding discs positioned inclined relatively to the radius and the direction of rotation of the rotating disc in such a manner as to retard displacement of the grinding produce in outward direction towards the periphery.

BRIEF DESCRIPTION OF THE DRAWINGS

Further objects, features and advantages of the invention will become apparent from the following description considered in connection with the accompanying drawings which show some preferred embodiments of the invention and form part of this specification and of which.

DETAILED DESCRIPTION OF A PREFERRED EMBODIMENT

Figure 1:
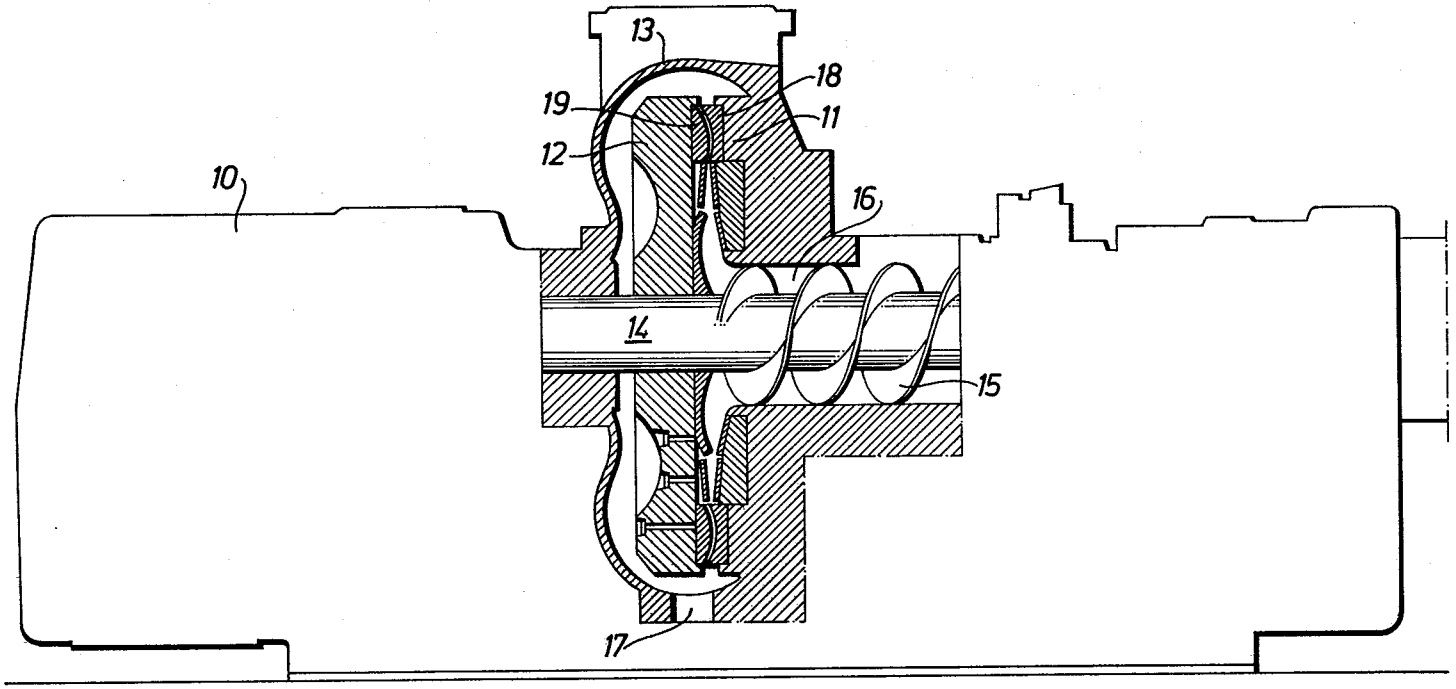
FIG. 1 is a sectional view of the central portion of a disc refiner, the other parts of the refiner being assumed to be housed within the contour line indicating the entire apparatus.

Referring now to the drawings and in particular FIG. 1, reference numeral 10 denotes the housing of a disc refiner which is shown in phantom contour and which houses the usual bearing and driving members for operating the apparatus, not shown herein in detail for reasons of clarity. The central part of the refiner represented here in section contains a non-rotating grinding disc 11 and a rotating grinding disc 12 and a housing 13 surrounding said grinding discs. The apparatus has a horizontal shaft 14 provided with a feed screw 15 for introducing the material to be ground through a central inlet opening 16 in the stationary grinding disc 11. The housing 13 has in its bottom portion an outlet 17 for discharging the ground produce which has passed radially outwards through the grinding interspace to the periphery of the discs.

Figure 2:
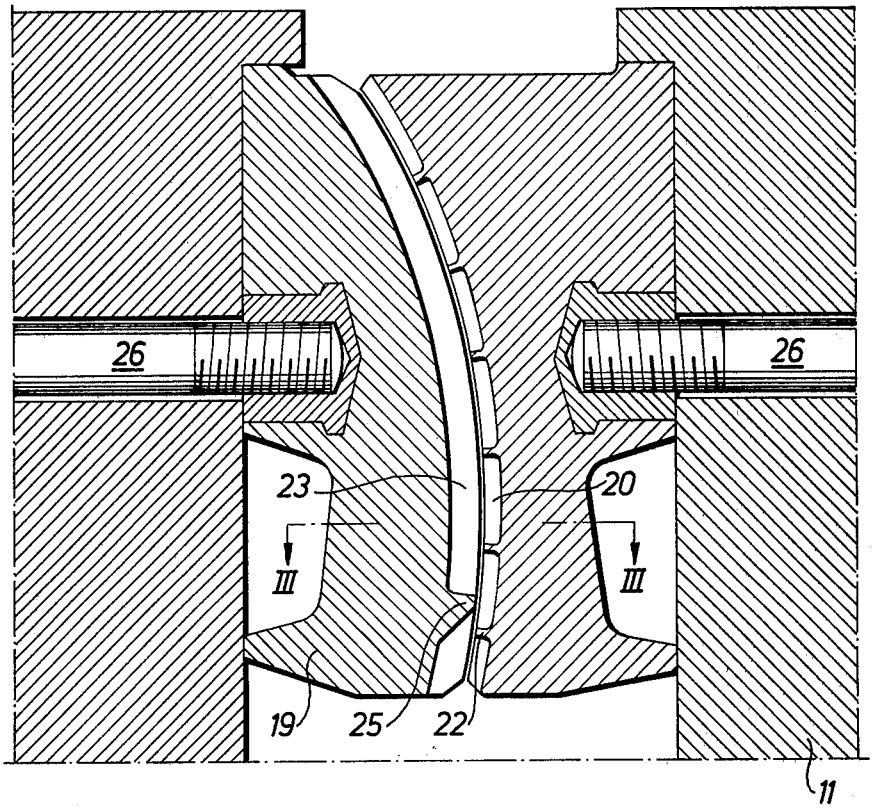
FIG. 2 is a sectional view in a larger scale of the grinding discs of the disc refiner of FIG. 1 along the outer circumference of the discs.

The facing surfaces of the grinding discs are composed of grinding segments which have different shapes in the various zones of the grinding interspace. Of interest as far as the present invention is concerned are the outer segments 18 and 19 only, for which reason the other segments have not been denoted in the drawings by reference numerals. The segments 18 and 19 are fixed onto the grinding discs by suitable means, such as bolts 26 (see also FIG. 2).

According to the invention, the segments 18, 19 of the grinding discs 11 and 12, respectively, are formed so that at least their outermost portion deviates from a substantially planar shape by being curved as in the embodiments shown in the drawings. In the latter portion, the outer surface of the segment 19 of the rotating disc constitutes the external surface of a cone and the inner surface of the segment 18 of the non-rotating disc 11, the internal surface of a cone. Due to the high speed of the rotating disc 12, the grinding produce is flung outwardly from the segment 19 on the rotating disc 12 towards the surface of the segment 18 on the stationary grinding disc 11.

Figure 3:
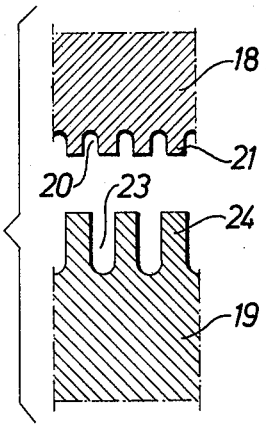
FIG. 3 is a sectional view in a still larger scale along line III—III in FIG. 2 through the portions facing one another of the grinding discs formed with ridges and grooves.
Figure 4:
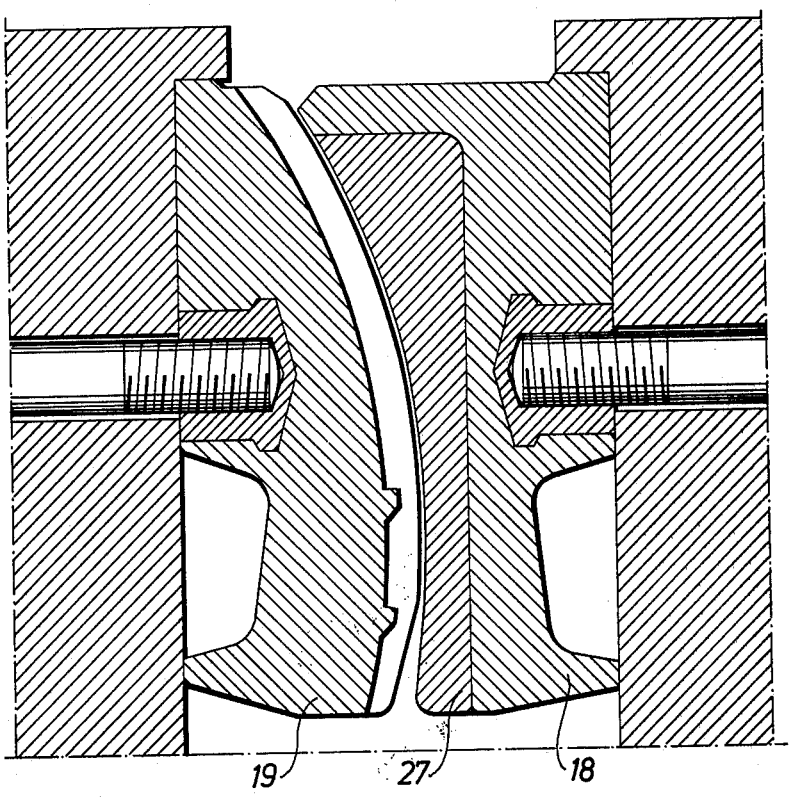
FIG. 4 is a sectional view similar to FIG. 2, showing a modified embodiment.

The segment 18 fixed onto the non-rotating disc 11 has radially extending grooves 20 (FIG. 3) and ridges 21 extending radially therebetween. In order to retard the grinding produce as well as steam centrifuged against the grinding segment 18 in the operation of the grinding apparatus, transverse ridges 22 are provided in the radially extending grooves 20. The segment 19 fixed onto the rotating grinding disc 12 also has radially extending grooves 23 and intervening ridges 24. Due to the effect of the centrifugal force, the grooves 23 in the segment 19 on the rotating grinding disc 12 are relieved of grinding produce, and in this way a space is formed within which the steam can flow unobstructed to the outer periphery of the grinding segment 19 without particles of the grinding produce being entrained therein. In order to still further increase this centrifugal effect, the grooves 23 in the rotating segment 19 are preferably deeper than the grooves 20 in the stationary segment 18. In order not to retard the flow of steam to the outer periphery but to allow removal of grinding produce by centrifugation from the grooves 23, transversely extending ridges are not necessary, and, therefore, have been eliminated from the grooves 23. However, immediately adjacent the inner peripheral portion of the segment, one transverse ridge 25 is provided for the purpose of conducting the grinding produce to the stationary grinding segment 18 at the transition from the preceding inner grinding zone to the outer grinding zone.

DESCRIPTION OF MODIFIED EMBODIMENTS

Figure 5:
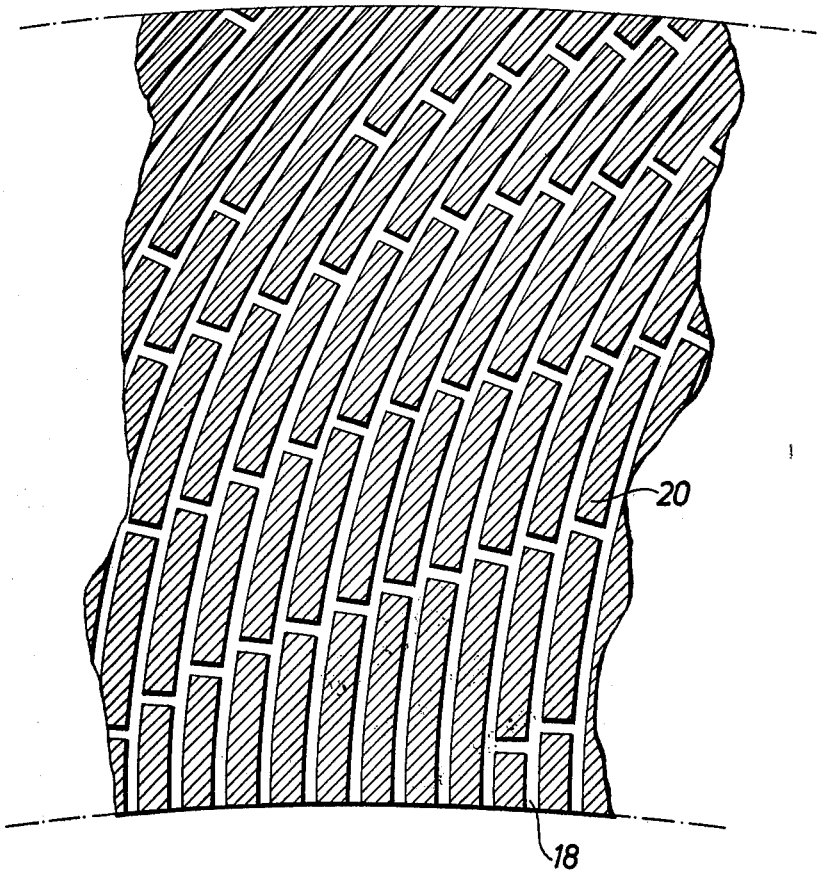
FIG. 5 is a view in a still larger scale of an embodiment where the grooves in a grinding disc segment have been given an especially advantageous shape.

As will easily be understood from the description hereinbefore, the removal of the steam is effected mainly in the rotating grinding segment 19, whereas the stationary grinding segment is not operative in this respect. For this reason, the surface of the grinding segment 18 can have a smaller pattern composed of some granular material 29, such as ceramic or pulverulent metallurgic material. The individual granules of this material can be cemented together by means of a sintering or bonding agent which is more rapidly affected by wear or erosion than the hard and resistant granular material. In order to produce the desired effect, the size of the granules must not exceed 1.5 millimeters. For the production of finer pulps for which this embodiment is primarily intended, the size of the granules must not exceed 0.5 millimeters. The embodiment according to FIG. 5 is also suitable for manufacturing of extremely fine pulps which normally are difficult to manufacture in disc refiners, in which case the granule size must not exceed 0.3 millimeters as a maximum value.

Some centrifugal effect and separation of grinding produce particles and steam could be accomplished principally in a grinding apparatus equipped with completely conical grinding surfaces. However, the separation is of importance mainly in the neighborhood of the outer circumference. In order not to make the rotating grinding disc unnecessarily heavy and at the same time to avoid unnecessarily great spacing between the bearings, it is appropriate to give the major portion of the discs 11, 12 a planar shape, even if a lesser portion of the discs adjacent the shaft is given a conical shape in order to facilitate introduction of the stuff to be ground. A portion of the grinding discs 11, 12 between the central shaft 14 and their outer periphery most suitably should be substantially planar in order to allow the curvature of the grinding interspace to be sufficiently sharp, while too small a cone angle at the outer circumference should be avoided.

In order to decelerate the radial movement of the grinding produce adjacent the periphery, the grooves 20 or 23, at least in one of the grinding segments 18 or 19, respectively, can be inclined relative to the radius and the direction of rotation of the rotating disc 12, so as to counteract the outward displacement of the material during grinding. The closer the material approaches the outer periphery, the greater will be its exposure to a gradually accelerating flow of steam. It is, therefore, practicable to retard the movement of the material more and more as it approaches the outer periphery. This can be accomplished by imparting to the inclined grooves 20 or 23 an arcuate form with a progressively increasing angle to the disc radius until the angle reaches its maximum value at the outer circumference of the grinding discs 11 and 12, as is illustrated in FIG. 5.

In all embodiments shown in the drawings, the grinding segments 18, 19 have been given such a shape as to impart to the grinding gap or interspace formed between them an arcuate or arched shape whereby the steam is forced in its flow to follow a curved path. This feature augments the effect of the centrifugal force in separating the steam from the solid particles of ground material in the grinding interspace. As mentioned heretofore, the steam may have a velocity substantially in the direction of the generatix of the arched surface. In this connection, the radius of curvature of the generatrix can be adapted to the desired centrifugal effect as far as the construction of the grinding apparatus permits. In order to ensure a satisfactory effect, said radius of curvature should not exceed 600 millimeters, the centripetal acceleration at the speed of 200 meters per second, thus becoming about 67,000 meters per second$^2$. However, it is more advantageous to work with a radius of curvature of 300 millimeters at the utmost, the centripetal acceleration then amounting to about 130,000 meters per second$^2$ corresponding to a gravitational field of 13,000 G. It is evident that this gravitational field creates a highly increased fall-out velocity for the solid particles suspended in the steam flow, said particles being forced to fall out in a direction away from the rotating disc 12 towards the non-rotating disc 11.

According to the invention described herein, the tendency of the grinding produce to leave the grinding interspace too rapidly together with the steam can be counteracted effectively. In addition, a second advantageous effect is obtained. During the grinding operation, the ground produce is accumulated in the grinding interspace adjacent the non-rotating grinding disc. The quantity of produce present in the grinding interspace is increased constantly by the retarded radial movement of the produce. As the quantity of grinding produce in the interspace increases, the apparatus will be subjected to an increased braking effect, or, in the alternative, the load on the apparatus can be maintained even if the width of the grinding interspace should be increased by axial displacement of one of the grinding discs. This is an advantageous effect, since the danger of shearing off fibers is thereby reduced. It should be understood that the grinding produce consists of fibers, fiber fragments and coarser wood particles suspended in steam under very strong turbulence. As soon as such coarser particles are exposed to the effect of the rotating disc, they are subjected to a very strong centrifugal action. This effect is increased further by the centrigural force of the steam flow which, due to the curved configuration of the grinding interspace, is forced to follow a curved path. The greater the size of the particles, the stronger will be the centrifugal force tending to return the particles to the vicinity of the non-rotating disc 11. A coarser particle which by chance may happen to be whirled into a groove 23 of the rotating disc 12 will thus have greater tendency to be flung back into the grinding interspace and towards the stationary disc 11, than a fine individual fiber or a fiber fragment which has a greater surface in relation to its weight, and as a consequence a lower fall-out velocity from the steam suspension. This feature causes the coarser wood particles possessing the higher fall-out velocity to be retained in the grinding apparatus for a longer time than the light individual fibers, the treatment of which is finished and which thus do not require any further processing. The feature of selectively retarding the coarser wood particles while being propelled radially increases the probability of complete defibration thereof before they leave the grinding interspace, which in turn means a reduced content of coarse particles, so-called splinters, in the produced pulp.

Obviously, the invention is not limited to the embodiments shown and described, but can be varied in many respects within the scope of the basic inventive concept. Thus, as heretofore mentioned, the grinding segments may have other shapes than those illustrated, and the arcuate portion of the grinding interspace may comprise a portion only of the outer segments. It should also be understood that the means and the attendant results apply with advantage also to apparatus for production of pulp according to the thermomechanical or semichemical methods.

While some more or less specific embodiments of the invention have been shown and described, it is to be understood that this is for the purpose of elucidation only and that the invention is not to be limited thereby, but its scope is to be determined by the appended claims.

What is claimed is:

1. In a grinding apparatus for producing ligno-cellulose pulp in which the pulp material is ground in an environment of steam between a rotating disc and a non-rotating disc enclosed within a housing, each of said discs comprising a series of peripherally disposed radially extending segments provided with ridges and intervening grooves forming opposing grinding surfaces and defining therebetween a grinding space of predetermined width which merges with a centrally located feed-in zone from which the pulp material is propelled by centrifugal force created by the rotating disc radially outwards through said grinding space, the improvement comprising:

means on the rotating segments effective to cause the centrifugal force to fling the pulp material towards the non-rotating segments to thereby create a passage means adjacent the surface of the rotating segments to allow the steam to escape from said grinding space substantially free of pulp material, said non-rotating segments being effective to retard the radially outward movement of the steam liberated material between the opposing grinding surfaces with resultant improved grinding effect.

2. The improvement according to claim 1, in which the passage means comprise radially extending grooves.

3. The improvement according to claim 1, in which the ridges and grooves on the non-rotating segments are disposed relative to the grinding space so as to produce greater resistance than that of the rotating segments to the radially outward movement of the pulp material.

4. The improvement according to claim 3, in which the grooves in the non-rotating segments are inclined relatively to the radius and the direction of rotation of the rotating segments so as to retard displacement of the pulp material in outward direction towards the periphery.

5. The improvement according to claim 4, in which the inclined grooves are arcuate in shape and extend with a progressively increasing angle to the disc radius from the inner periphery to the outer periphery of the segments.

6. The improvement according to claim 1, in which the grinding surface of the non-rotating segments comprises a granular material having a particle size not exceeding 1.5 millimeters.

7. The improvement according to claim 6, in which the particle size is 0.5 millimeters.

8. The improvement according to claim 6, in which the particle size is 0.3 millimeters.

9. The improvement according to claim 1, in which the grinding space has a curved profile, the non-rotating segments having a concave contour and the rotating segments having a convex contour.

* * * * *